United States Patent [19]

Karlovsky

[11] Patent Number: 4,531,784

[45] Date of Patent: Jul. 30, 1985

[54] MINING MACHINE WITH DUST COLLECTOR APPARATUS

[75] Inventor: Jerry Karlovsky, Russell, Ky.

[73] Assignee: National Mine Service Company, Pittsburgh, Pa.

[21] Appl. No.: 476,226

[22] Filed: Mar. 17, 1983

[51] Int. Cl.[3] ..... E21C 35/22; E21C 7/00

[52] U.S. Cl. ..... 299/64; 299/12; 299/81

[58] Field of Search ..... 299/12, 81, 64

[56] References Cited

U.S. PATENT DOCUMENTS

| | | | |
|---|---|---|---|
| 3,603,644 | 4/1971 | McCleery | 299/12 |
| 3,712,678 | 1/1973 | Amoroso | 299/12 |
| 3,792,568 | 2/1974 | Gundlach | 299/64 |
| 3,810,677 | 5/1974 | David | 299/12 |
| 3,964,246 | 9/1975 | Gandy et al. | 299/12 |
| 4,076,315 | 2/1978 | Gundlach | 299/12 |
| 4,157,264 | 6/1979 | Kissell | 299/64 |
| 4,200,036 | 4/1980 | Matte | 299/1 |
| 4,249,778 | 2/1981 | McGuire | 299/12 |
| 4,266,829 | 5/1981 | Divers | 299/12 |
| 4,289,509 | 9/1981 | Höller | 299/12 |
| 4,351.567 | 9/1982 | Gillingham | 299/12 |
| 4,380,353 | 4/1983 | Campbell | 299/12 |

*Primary Examiner*—James A. Leppink
*Assistant Examiner*—William P. Neuder
*Attorney, Agent, or Firm*—Stanley J. Price, Jr.

[57] ABSTRACT

A continuous mining machine is propelled on a mobile body and includes a boom pivotally secured to the mobile body and extending forwardly therefrom. The boom rotatably supports a material dislodging device having cutting elements extending therefrom for dislodging material from a mine face. A longitudinal conveyor extends rearwardly on the body portion from a front end portion positioned rearwardly of the material dislodging device to a discharging end portion. A dust collector is carried by the boom in overlying relation with the conveyor front end portion. The dust collector includes a housing having a plurality of laterally spaced inlets for receiving pollutant laden air. A duct system connects the inlets to corresponding outlets where the air free of pollutants is discharged. A plurality of water spray manifolds are positioned in the housing at the inlets and direct a high pressure liquid spray to the outlets to induce an accelerated flow of pollutant laden air into the dust collector. The pollutant laden air is mixed with the liquid spray and flows through the duct system to the respective outlets. Each outlet includes a mist eliminator module for filtering the mixture of liquid and pollutants from the flow of air through the duct system. The air free of pollutants is discharged at an accelerated flow rate from the outlets and the liquid-pollutants slurry is drained from the mist eliminator module and directed onto the conveyor below the boom.

10 Claims, 7 Drawing Figures

MINING MACHINE WITH DUST COLLECTOR APPARATUS

BACKGROUND OF THE INVENTION

1. Field of the Invention

This invention relates to a mining machine and more particularly to apparatus mounted on the mining machine for collecting pollutant laden air and separating the pollutants from the air at the mine face during the material dislodging operation.

2. Description of the Prior Art

Federal regulations require that designated areas in underground coal mines comply with controls on the levels of airborne respirable dust permitted at the mine face. Consequently, there have been a number of recent developments in dust abatement in underground mining as disclosed in U.S. Pat. Nos. 3,712,678; 3,792,568; 4,076,315; 4,157,204 and 4,200,036. The United States Bureau of Mines has also developed a twin fan scrubber system for continuous miners. This system combines water scrubbing with ventilation and includes a pair of air ducts mounted on the mining machine boom in which pollutant laden air flows into the inlets of the ducts where water sprays direct a spray of water into the air. The mixture of water spray and pollutant laden air is drawn by a motor driven fan past a scrubber panel to a demister section in the duct. The demister section extracts the pollutants in slurry form from the air flow, which is discharged through an outlet free of the pollutants.

U.S. Pat. Nos. 3,792,568 and 4,076,315 disclose air scrubbers on mining machines for separating the pollutants from the air moving through a duct. The air scrubber has a revolving rotor mounted in a rotor passage of a housing. The rotor causes a flow of air to the scrubber in which the pollutants are removed and the resultant clean air is directed toward the mine face. The pollutants may be discharged onto the conveyor which transports the dislodged material rearwardly on the mining machine. U.S. Pat. No. 3,712,687 also discloses a dust collecting device that utilizes centrifugal fans to draw dust entrained air through openings in collecting chambers where wet-type air scrubbers discharge a curtain of water into a duct causing wetting of the pollutants carried by the air flowing through the duct. The pollutants fall downwardly onto the bottom of the duct where they are removed through a discharge outlet onto the conveyor that transports the material from the mine face.

While it has been suggested to separate pollutants from the air by dust collectors, such as air scrubbers or wet dust collectors, mounted on a continuous mining machine to reduce the levels of airborne respirable dust created by the mining operation, the known devices utilize mechanical fans for moving the air through the dust collector. The fans must have a capacity capable of moving the quantity of air desired at a selected flow rate through the dust collector. The use of fans and motors for operating the fans substantially complicates the dust abatement operation by the need to provide electrical service and the related components for operating the fans. Space must be made available on the mining machine to accommodate the dust collector including the motor, fan and associated electrical equipment. The addition of this equipment on the mining machine creates maintenance problems, increases the noise level of an operating mining machine and in the event motor or fan should become inoperative, requires that the mining machine be shut down until the dust collector is restored to operation.

Therefore, there is need for dust collecting apparatus on a mining machine that eliminates the problems associated with the conventional dust collectors having motor driven fans by preferably eliminating the need for electrical service to the dust collector while being operable to efficiently remove the pollutants from the air generated during the mining operation.

SUMMARY OF THE INVENTION

In accordance with the present invention, there is provided a mining machine that includes a mobile body portion. A boom member is pivotally secured to the body portion and extends forwardly therefrom. A material dislodging device is rotatably mounted on the front end of the boom member. A conveyor extends rearwardly on the body portion. The conveyor has a front end portion including means for gathering and receiving material dislodged by the material dislodging device and a discharge end portion for discharging dislodged material conveyed rearwardly on the body portion. Dust collecting means is carried by the boom member in overlying relation with the conveyor front end portion for removing pollutants entrained in the air surrounding the material dislodging device. The dust collecting means includes a housing having an inlet for receiving pollutant laden air, and outlet for discharging air free of pollutants and a passageway connecting the inlet with the outlet. Spray means is mounted in the housing at the inlet for directing a high pressure, liquid spray from the inlet to the outlet to induce an accelerated flow of the pollutant laden air through the passageway into mixture with the liquid spray. Filter means mounted in the housing at the outlet separates a high velocity flow of air, free of pollutants from a slurry including the liquid mixed with the pollutants removed from the air. Means is associated with the filter means at the outlet for discharging a high velocity flow of air substantially free of pollutants in a first direction and the slurry in a second direction from the housing.

The dust collecting housing is positioned transversely across the boom member in overlying relation with the front end of the conveyor which includes a material gathering device. With this arrangement, the dust collecting housing bridges the front end portion of the conveyor rearwardly of the material dislodging device so as to be located at the point of maximum concentration of pollutants in the air. To effectively remove the pollutants from the air across the width of the material dislodging device, a plurality of inlets are positioned centrally and laterally of the boom member so that pollutant laden air is drawn into the housing from a plurality of directions rearwardly of the material dislodging device. In this manner, substantially all the particulate laden air surrounding the material dislodging device is effectively treated during the mining operation.

The pollutant laden air is drawn into the inlets of the dust collecting housing and is subjected to a high velocity liquid spray from the spray means. The spray means preferably includes a liquid manifold having a plurality of nozzles which discharge a liquid spray mist through a duct system from the inlets to the outlets. The spray mist is discharged at a high pressure, and induces a high velocity flow of pollutant laden air into the dust collecting housing and into mixture with the liquid spray. The pollutant laden air entrained in the high pressure spray passes through the duct system to the filter means at the outlets. The filter means at each outlet includes a demister that substantially separates the liquid and pollutants from the cleaned air. The pollutants are entrained in the liquid spray to form a slurry that is directed from the demister onto the gathering head at the front of the conveyor. From the gathering head the slurry is transferred to the conveyor where it is conveyed with the dislodged material rearwardly on the mining machine. Thus, clean air is discharged at a high flow rate from the housing back into the atmosphere surrounding the material dislodging device.

Accordingly, the principal object of the present invention is to providing a mining machine having dust collecting devices carried by the boom rearwardly of the material dislodging device for collecting and separating from the air pollutants that are entrained in the air as a result of the mining operation.

Another object of the present invention is to provide a dust collecter for a mining machine that utilizes high pressure nozzles to induce flow of pollutant laden air into mixture with liquid sprays for separation of the pollutants in a slurry from the cleaned air which is recirculated back into the atmosphere at the mine face.

A further object of the present invention is to provide pollutant abatement equipment on a mining machine in which high velocity flow of pollutant laden air into a scrubber is generated by high pressure water spray through a duct system to remove airborne respirable dust from the atmosphere at the mine face during the mining operation in a manner that does not require the use of electrically powered fans.

An additional object of the present invention is to provide a low maintenance scrubber system carried by the boom of a mining machine in overlying relation with the mining machine conveyor and positioned closely adjacent and rearwardly of the material dislodging device where the pollutants generated during the mining operation are effectively removed from the air by water sprays to generate a high velocity air flow without the need for electrical equipment.

These and other objects of the present invention will be more completely disclosed and described in the following specification, the accompanying drawings and the appended claims.

DESCRIPTION OF THE PREFERRED EMBODIMENTS

Figure 1:
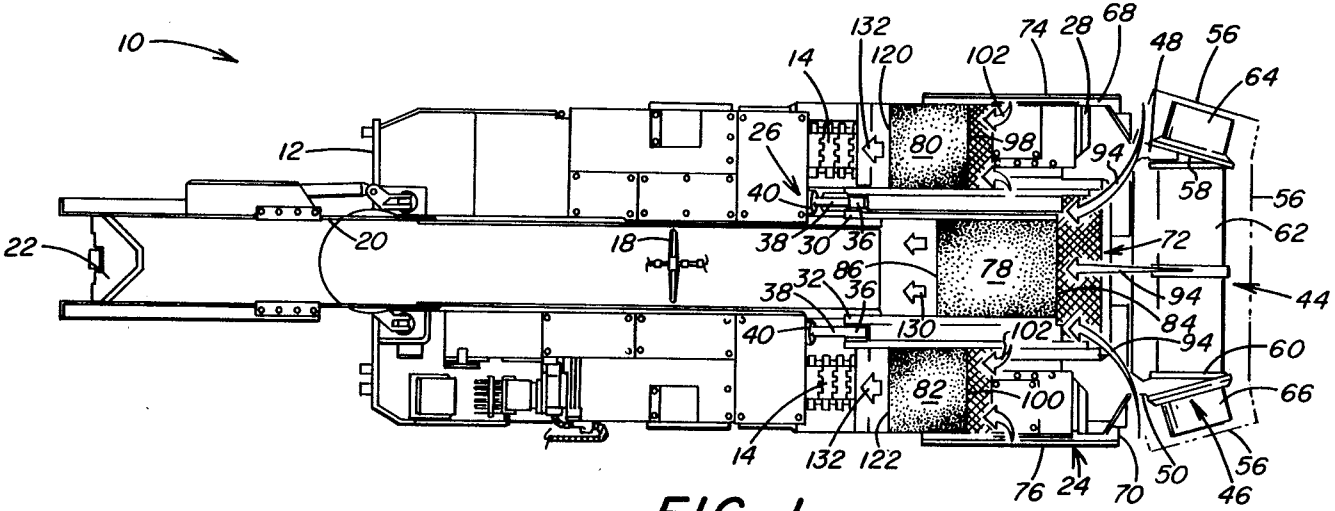
FIG. 1 is a top plan view of a continuous mining machine illustrating a boom carrying a dust collecting device positioned rearwardly of a cutter drum in overlying relation with the front end portion of a conveyor.
Figure 2:
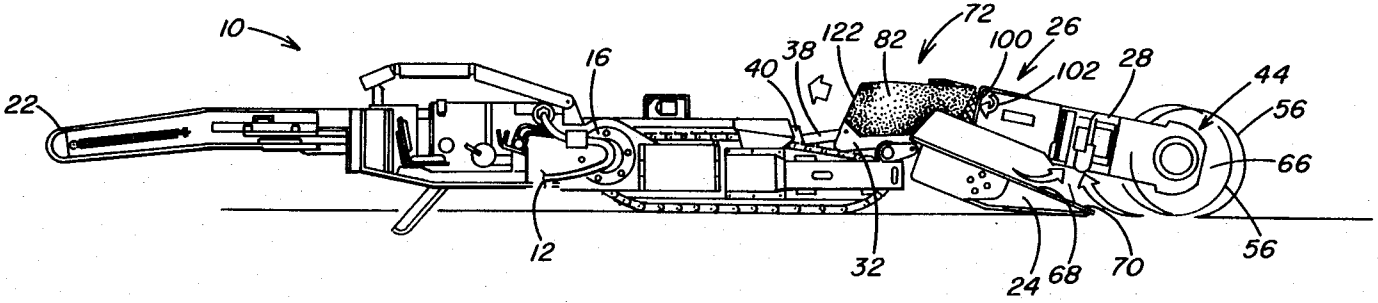
FIG. 2 is a view, in side elevation, of the continuous mining machine shown in FIG. 1, illustrating the dust collecting device positioned in overlying relation with the gathering head of the conveyor.

Referring to the drawings, and particularly to FIGS. 1 and 2, there is illustrated a continuous mining machine, generally designated by the numeral 10 having a body or frame portion 12 suitably mounted on endless crawler tracks 14. An electric motor 16 is provided to propel the mining machine 10 on the endless crawler tracks 14 to advance the mining machine during the mining operation. An endless conveyor means 18 is positioned in a longitudinal trough member 20 and conveys dislodged material therein from the front of the mining machine to an articulated rear discharge section 22. The conveyor means 18 includes a gathering device which is later described. As illustrated in FIG. 2, a material gathering device 24 extends forwardly from the body portion 12 and is arranged to receive, gather and feed the dislodged material into the conveyor trough 20 from which the dislodged material is conveyed rearwardly by the endless conveyor means 18 to the discharge section 22.

As further illustrated in FIGS. 1 and 2, a boom member generally designated by the numeral 26 extends forwardly from the body portion 12. The boom member 26 includes a front end portion 28 positioned in overlying relation with the gathering device 24, and the boom member 26 extends rearwardly on the body portion 12 therefrom. The boom member 26 includes a pair of arm members 30 and 32 that are connected at their rearward end portions to the mining machine body portion 12. Each of the arm members 30 and 32 is connected at a connection point 36 to a piston rod 38 of a piston cylinder assembly 40. The pair of piston cylinder assemblies 40 and the boom arm members 30 and 32 are, in turn, pivotally connected to the mining machine body portion 12.

Extension and retraction of the piston rods 38 relative to the piston cylinder assemblies 40 pivots the boom member 26 on the machine body portion 12. In this manner, the boom member 26 is raised and lowered to perform a shear cut of the mine face. The mining machine 12 is, for example, operable to advance into the mine face with the boom member 26 in the upper position and then the piston cylinder assemblies 40 pivot the boom member 26 downwardly to dislodge material from the mine face by a downward shear cut.

The boom member 26 extends forwardly of the mining machine body portion 12. A material dislodging device, such as a cutter drum 44, is supported by a drum housing 46. The drum housing 46 includes a pair of rearwardly extending arms 48 and 50 that are connected to the front end portion 28 of the boom member 26. A pair of cutter drum motors (not shown) are mounted on the drum housing 46 and are operable to rotate the cutter drum 44. A drive shaft is drivingly connected to each of the cutter drum motors and extends forwardly therefrom to the drum housing 46. The connection of the cutter drum motors to the drive gearing for the cutter drum 44 is described and illustrated in greater detail in U.S. Pat. No. 3,848,930.

The drum housing 46 includes housing portions 58 and 60 that extend forwardly from the arm members 48 and 50. The rotatable portions of the cutter drum 44 are mounted on the housing portions 58 and 60 which are nonrotatable. The drive means for the cutter drum 44 extends through the housing portions 48 and 50 and are connected to the gearing within the cutter drum 44 to rotate the cutter drum to dislodge material from the mine face.

The cutter drum 44 has an intermediate drum section 62 and a pair of end drum sections 64 and 66. The intermediate drum section 62 is rotatably supported by the housing portions 58 and 60. The end drum section 64 is canted with respect to the intermediate drum section 62 and is rotatably supported by the housing portion 58. The drum end section 66 is also canted with respect to the intermediate drum section 62 and is rotatably supported by the housing portion 60. The intermediate drum section 62 and the end drum section 64 and 66 include a plurality of cutting elements that extend peripherally from the respective drum sections.

The bit pattern formed by the cutting elements is schematically indicated by the outline 56 illustrated in FIGS. 1 and 2.

The end drum sections 64 and 66 are positioned so that the bit pattern 56 formed by the rows of cutting elements overlap the bit pattern 56 of the row of cutter elements along the intermediate drum section 62. With this arrangement, as further disclosed in greater detail in U.S. Pat. No. 3,848,930, the cutter drum 44 is operable to dislodge a continuous kerf of material from the mine face without leaving unmined portions in the face. As the cutter drum 44 completes a shear cut in the mine face, a relatively horizontal roof and floor are formed in the mine passage.

The material dislodged by the cutter drum 44 is picked up and deposited onto the gathering device 24. The gathering device 24 is conventional and includes a pair of gathering arms that are mounted on opposite sides of the front end portion of the conveyor mechanism 18. The gathering arms are connected to a pair of disc members that are rotatably supported on a gathering platform, illustrated in FIG. 2. The disc members are driven to transversely pivot the arm members toward and away from the front end of the conveyor mechanism 18. As further illustrated in FIG. 2, the gathering platform 68 has a ground engaging forward edge portion or apron 70 arranged to advance on the mine floor rearwardly and below the cutter drum 44. With this arrangement, the material dislodged by the cutter drum 44 is deposited by a scrolling action directly onto the gathering platform 68 at the forward edge portion 70 or forwardly of the edge portion 70 on the mine floor and then, as the mining machine is advanced, the dislodged material on the mine floor is picked up by the forward edge portion 70 of the gathering platform 68. The gathering platform 68 can also be elevated above the mine floor so as to permit tramming of the mining machine 10 from one operating location to another.

In accordance with the present invention, a dust collecting device, generally designated by the numeral 72, is carried by the boom member 26 in overlying relation with the front end portion of the conveyor mechanism 18 and the gathering platform 68. The dust collecting device 72 is integrally connected to the boom arm members 30 and 32 so as to be selectively positioned centrally immediately over the front end portion of the endless conveyor 18 at the rear center of the cutter drum 44 and laterally over the side edges of the gathering platform 68 to the rear of the platform forward edge portion 70. As illustrated in FIG. 1, the gathering platform 68 includes side edge portions 74 and 76 and the dust collecting device 72 extends laterally to a position inboard and spaced closely adjacent to the gathering platform side edge portions 74 and 76.

As illustrated in FIG. 1, the dust collecting device 72 includes a center unit 78 and a pair of side units 80 and 82. The center unit 78 is positioned in overlying relation with the front end portion of the conveyor mechanism 18 between the boom arm members 30 and 32. The side units 80 and 82 are positioned outboard of the boom arm members 30 and 32 and extend adjacent to the gathering platform side edge portions 74 and 76. The dust collecting units 78, 80 and 82 are formed as an integral part of the boom arm members 30 and 32.

Figures 3, 4, 5, 6, 7:
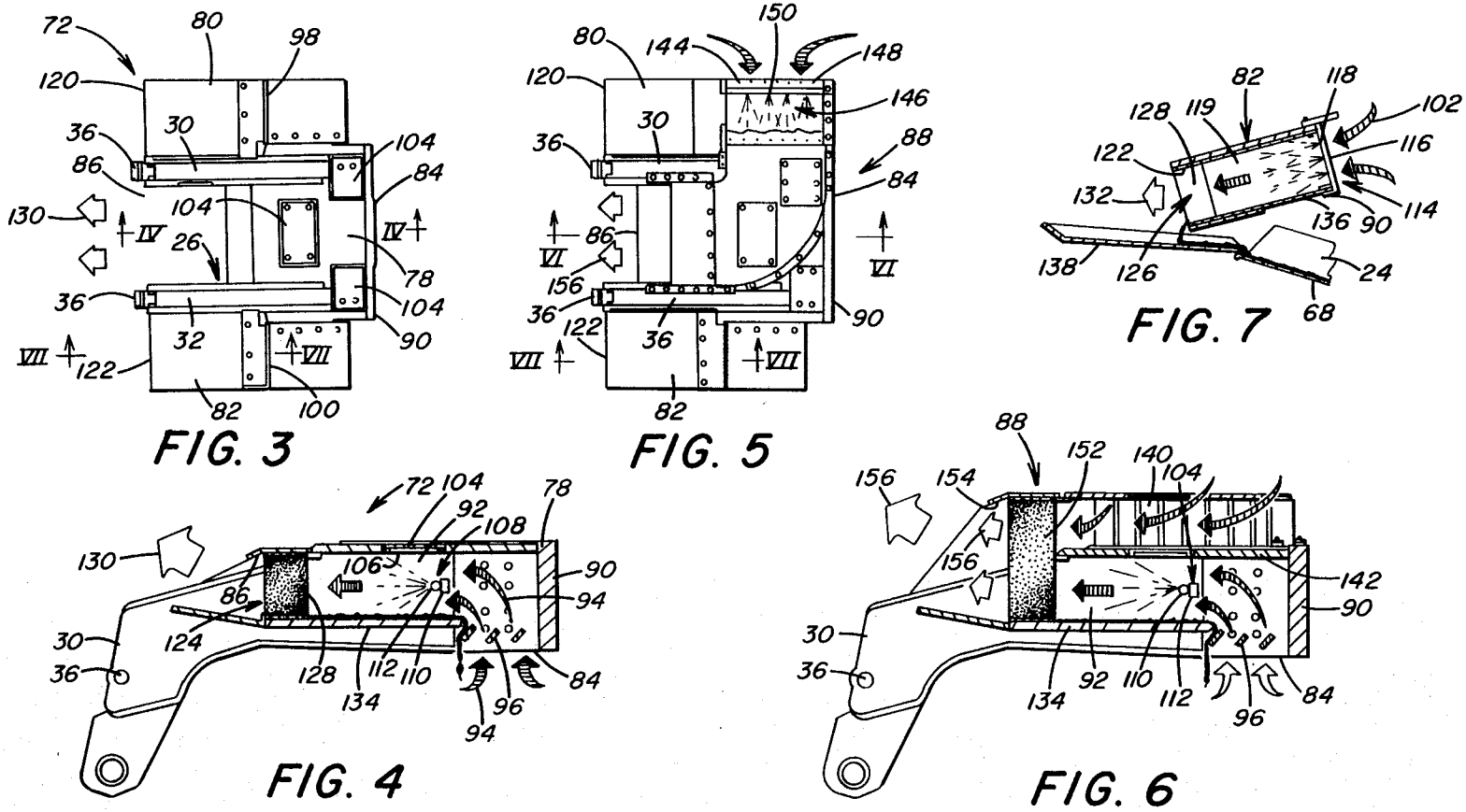
FIG. 3 is a top plan, schematic view of the dust collecting device on the boom of the mining machine illustrated in FIG. 1.
FIG. 4 is a sectional view taken along line III—III of FIG. 4.
FIG. 5 is a view similar to FIG. 3, illustrating another embodiment of the dust collecting device.
FIG. 6 is a sectional view taken along line VI—VI of FIG. 5, illustrating a plurality of inlets for receiving pollutant laden air.
FIG. 7 is a sectional view, taken along line VII—VIII of FIGS. 3 and 5, illustrating the relationship of the dust collecting device to the gathering head of the mining machine conveyor.

The center unit 78, as illustrated in FIGS. 1, 3 and 4, includes an inlet 84 for receiving pollutant laden air including respirable dust particles generated during the mining operation and an outlet 86 for discharging air substantially free of pollutants back into the atmosphere surrounding the cutter drum 44. As is well known, the pollutant laden air includes airborne respirable dust generated during the material dislodging operation. The details of the dust collecting device 72, shown in FIG. 1, are illustrated schematically, in greater detail, in FIGS. 3, 4 and 7. An alternate embodiment of a dust collecting device generally designated by the numeral 88 is illustrated in FIGS. 5 and 6 and will be described later in greater detail.

The dust collecting device 72 shown in FIGS. 1–4 and 7 includes a housing 90, which is formed as an integral part of the boom member 26. The housing 90 spans the boom member 26 to support the collector units 78, 80 and 82 centrally and laterally of the boom arm members 30 and 32. The housing 90 forms a duct system, including a passageway 92 for the center unit 78 illustrated in detail in FIG. 4. The passageway 92 is enclosed by cover plates and side plates which form the housing 90. The passageway 92 is accessible by the front inlet 84, which provides a flow path, as indicated by the directional arrows 94 for the flow of pollutant laden air through the inlet 84 into the passageway 92. With this arrangement the inlet 84 is positioned between and below the boom arm members 30 and 32 above the conveyor 18.

Baffles 96 are positioned in the passageway 92 at the inlet 84 so as to divert the air drawn into the inlet 84 upwardly and into the passageway 92. Also positioned laterally of the inlet 84 are side inlets 98 and 100 through which pollutant laden air is also drawn into the duct system for the collector units 80 and 82, as indicated by the directional arrows 102 shown in FIGS. 1, 2 and 7. As shown in FIGS. 3 and 4, the housing 90 includes removable access covers 104 that close openings 106 into the passageway 92.

Positioned adjacent the center inlet 84 in the passageway 92, as shown in FIG. 4, is a spray device generally designated by the numeral 108 that includes a manifold 110 and a plurality of high velocity nozzles 112 associated with the manifold 110. The manifold 110 is connected to a source of liquid, such as water, and the liquid is supplied to the manifold 110 and is discharged from the nozzles 112 at a high velocity as a mist into the passageway 92. The pollutant laden air is drawn into the inlet 84 by the high velocity liquid spray, and the respirable dust particles become entrained in the droplets of the liquid spray.

The side collector unit 82 is illustrated in FIG. 7. Each of the side collector units 80 and 82 includes a spray device generally designated by the numeral 114, having a liquid manifold 116 and a plurality of nozzles 118 through which the liquid is projected in a high velocity mist into a side passageway 119 associated with the inlets 98 and 100. In an operative example of the present invention, the spray devices 108 and 114 supply liquid at a flow rate between about 3 to 10 gallons power minute at a pressure in the range between about 150 to 500 p.s.i. The stream of liquid projected into the passageways 92 and 119 at this flow rate and pressure can induce an air flow of pollutant laden air into the inlets 84, 98 and 100 in the range between about 1,000–3,000 cubic feet per minute. In this manner a high volume, high velocity flow of pollutant laden air is drawn into the dust collecting device 72 without the use of an electrically powered fan or the like requiring electrical service to the dust collecting device. This also eliminates positioning a fan or rotor in the duct system. By eliminating the need for mechanical fans, the dust collecting device 72 of the present invention has substantially reduced maintenance requirements in comparison with fan powered dust collectors. The elimination of the fan and motor also substantially reduces the noise in the operation of the device 72.

The pollutant laden air is drawn at a high velocity into the inlets 84, 98 and 100 by the spray of liquid through the manifolds 110 and 116 and the associated nozzles 112 and 118. The pollutant laden air is mixed with the high velocity spray and carried therewith through the passageways 92 and 119 toward the respective outlets 86, 120, and 122. The outlet 86 is shown in FIG. 4 and the outlet 120, which is also representative of the outlet 122, is shown in FIG. 7. Positioned in the passageways 92 and 119 in advance of the respective outlets 86, 120 and 122 are filter modules generally designated by the numerals 124 in FIG. 4 and 126 in FIG. 7. Each of the filters 124 and 126 is securely mounted to the housing 92 at the respective outlets and is operable to separate the high velocity flow of air substantially free of pollutants from a slurry which includes the liquid mixed with the pollutants removed from the air.

Preferably each of the filters 124 and 126 includes a mist eliminator module 128 which is operable to eliminate the liquid-pollutant slurry from the cleaned air. A commercially available mist eliminator module adaptable for use with the present invention is sold by Donaldson Company, Inc. of Minneapolis, Minn. under part no. P15-0234 in a water-powered dust collector known as the Jet Spray Air Mover. Clean air is directed from the modules 128 as indicated by arrows 130 and 132 in FIGS. 1, 4 and 7 out of the housing 92 and into the atmosphere closely adjacent to the cutter drum 44 where the concentration of pollutants in the air is the greatest during the mining operation.

The slurry of liquid and pollutants is discharged onto the gathering device 24 which is positioned immediately below the dust collecting device 72. In one method of operation, the slurry is discharged from the center unit 78 of the dust collecting device 72 and flows aong the surface of a lower plate 134 of housing 90 in a direction opposite to the direction of air flow through the passageway 92. The slurry flows on the lower plate 134 to the inlet 84 and downwardly through the inlet 84. The slurry flow is diverted away from the incoming air by the baffle 96 which is positioned adjacent to the leading edge of the lower plate 134. The slurry is discharged from the plate 134 through the inlet 84 onto the receiving end portion of the conveyor mechanism 18. The slurry is carried with the dislodged material gathered by the gathering device 24 rearwardly to the discharge section 22 of the conveyor 18.

The slurry separated from the clean air by the mist eliminator modules 128 located at the side units 80 and 82 is discharged from a lower plate 136, as shown in FIG. 7 onto a drain pan 138. The drain pan 138 is positioned in underlying relation with the respective outlets 120 and 122 and is inclined downwardly and extends forwardly toward the gathering platform 68 of the gathering device 24. In this manner, the slurry from the side dust collecting units 80 and 82 is directed onto the gathering device 24 where it is conveyed with the dislodged material onto the conveyor mechanism 18 as above described.

Further in accordance with the present invention, there is provided an alternate embodiment of a dust collecting device generally designated by the numeral 88 in FIGS. 5 and 6. The dust collecting device 88 is identical to the dust collecting device 72 above described and illustrated in FIGS. 3–4 insofar as the housing 90, the inlet 84, passageway 92 and outlet 86. Further the dust collecting device 88 includes the spray device 104 having the manifold 110 and nozzles 112, as above described, for the dust collecting device 72 illustrated in FIG. 4.

The dust collecting device 88 as shown in FIG. 6 includes an upper passageway or duct separated from the lower passageway 92 by the upper plate 142 of the housing 90. The upper passageway 140 as seen in FIG. 5 includes an inlet 144 which is positioned laterally and at a right angle relative to the inlet 84 and positioned at an elevated level on the dust collecting device 88. Positioned at the inlet 144 in the upper passageway 140 is a spray device generally designated by the numeral 146 in FIG. 5 that includes a liquid manifold 148 provided with a plurality of high velocity nozzles 150 for subjecting high velocity liquid spray into the upper passageway 140 at the inlet 144 to induce flow of the pollutant laden air into the inlet 144. The high velocity spray induces an acelerated flow of a substantial volume of pollutant laden air into the upper passageway 140 and through the upper passageway 140 to a mist eliminator module 152 that is operable to eliminate the liquid-pollutant slurry from the air passing through both the lower passageway 92 and the upper passageway 140. The mist eliminator module 152 is identical in type to the mist eliminator modules 128 illustrated in FIGS. 4 and 7.

The dust collecting device 88 illustrated in FIGS. 5 and 6 also includes the side units 80 and 82, as above described, for the dust collecting device 72 illustrated in FIG. 3. Accordingly, the side unit 82 for the unit 88 is identical to the side unit 82 shown in FIG. 7. The slurry of liquid and pollutants is eliminated from the air which passes through an expanded outlet 154 of the unit 88 in the direction indicated by arrows 156 shown in FIG. 6. In one method of operation, the slurry is discharged downwardly onto the lower plate 134 and through the inlet 84 onto the front end of the conveyor from which it is rearwardly conveyed with the dislodged material. In another method of operation, the slurry of pollutants entrained in the liquid can be conveyed from each of the mist eliminator modules 128 and 152, above described, by the provision of a pump, such as a venturi pump, to the gathering device 24 or to any point on the conveyor 18. Thus, with the dust collecting device 88 as illustrated in FIGS. 5 and 6, the present invention is adaptable with either right or left air flow patterns into the respective dust collecting device as determined by the application of the dust collecting device in an underground mine either on a mining machine of the type described above, or any other vehicle used in underground mining operations where the elimination of pollutants from the working environment is essential.

According to the provisions of the patent statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. A mining machine comprising, a mobile body portion, a boom member pivotally secured to the body portion and extending forwardly therefrom, a material dislodging device rotatably mounted on the front end of the boom member, a conveyor extending rearwardly on the body portion, said conveyor having a front end portion including means for gathering and receiving material dislodged by said material dislodging device and a discharge end portion for discharging dislodged material conveyed rearwardly on the body portion, dust collecting means carried by said boom member in overlying relation with said conveyor front end portion for removing pollutants entrained in the air surrounding said material dislodging device, said duct collecting means including a housing having an inlet for receiving pollutant laden air, an outlet for discharging air free of pollutants and a passageway connecting said inlet with said outlet, spray means mounted in said housing at said inlet for directing a high pressure, liquid spray from said inlet to said outlet to induce an accelerated flow of the pollutant laden air through said passageway into mixture with the liquid spray, filter means mounted in said housing at said outlet for separating a high velocity flow of air free of pollutants from a slurry including the liquid mixed with the pollutants removed from the air, means associated with said filter means at said outlet for discharging said high velocity flow of air substantially free of pollutants in a first direction and said slurry in a second direction from said housing, a second passageway in said housing above said first mentioned passageway, said second passageway extending laterally relative to said first mentioned passageway, a laterally positioned inlet connected by said second passageway to said outlet, and said laterally positioned inlet including said spray means for inducing an accelerated flow of pollutant laden air into said housing in a direction laterally of said boom member.

2. A mining machine as set forth in claim 1 in which, said boom member includes a pair of spaced apart boom arm members extending forwardly of said body portion and connected to said material dislodging device, said conveyor being positioned between said pair of boom arm members, said dust collecting means housing being connected to said pair of boom arm members, said housing inlet being positioned between said pair of boom arm members above said conveyor front end portion for drawing into said housing a flow of pollutant laden air, and said housing outlet being positioned rearwardly of said housing inlet above said pair of boom arm members for supplying a flow of air free of pollutants back into the atmosphere above said boom member.

3. A mining machine as set forth in claim 1 in which, said dust collecting means housing includes an opening positioned above said conveyor for discharging said slurry of liquid and pollutants onto said conveyor, and a flow passage connecting said filter means with said opening for directing said slurry out of said housing onto said conveyor.

4. A mining machine as set forth in claim 1 in which, said boom member includes a pair of spaced apart boom arm members extending forwardly of said body portion and connected to said material dislodging device, said conveyor being positioned between said pair of boom arm members, said dust collecting housing being mounted on said pair of boom arm members above said conveyor and closely adjacent said material dislodging means, and said dust collecting means housing being movable with said pair of boom arm members.

5. A mining machine as set forth in claim 1 in which, said boom member includes a pair of spaced apart arm members extending forwardly of said body portion on opposite sides of said conveyor, said dust collecting means housing being connected to said boom arm members in a position extending between said boom arm members above said conveyor, and said housing inlet being positioned above said conveyor and below and between said boom arm members.

6. A mining machine as set forth in claim 5 which includes, a pair of inlets extending into said housing and positioned laterally of said housing inlet positioned between said boom arm members, said pair of inlets including said spray means, and said pair of inlets being positioned outboard of said boom arm members in overlying relation with said conveyor front end portion rearwardly of said material dislodging device.

7. A mining machine as set forth in claim 6 which includes, a pair of outlets in said housing, passageway means for connecting said pair of inlets with said pair of outlets, and said filter means being mounted in said pair of outlets for separating the accelerated flow of air substantially free of pollutants from said slurry being discharged from said housing onto said conveyor front end portion.

8. A mining machine as set forth in claim 1 in which, said housing includes a lower plate extending between said inlet and said outlet in said first mentioned passageway, said filter means being positioned in said outlet above said lower plate, and said lower plate arranged to receive the slurry separated from the air substantially free of pollutants and provide a path for the flow of the slurry away from said outlet through said passageway to said inlet for discharge of the slurry out of said inlet onto said conveyor.

9. A mining machine as set forth in claim 1 in which, said spray means includes a manifold positioned in said housing at said inlet, said manifold being connected to a source of liquid, and said manifold including a plurality of nozzles for directing a high pressure spray of liquid from said inlet to said outlet to induce an accelerated flow of pollutant laden air entrained in said high pressure, liquid spray through said first mentioned passageway and said second passageway to said outlet.

10. A mining machine as set forth in claim 1 in which, said filter means includes a mist eliminator module for receiving the flow of pollutant laden air mixed with the liquid spray at said outlet, and said mist eliminator module being operable to separate the slurry mixture of the liquid and the pollutants from the air flowing through said first mentioned passageway and said second passageway and direct the slurry onto said conveyor and the air substantially free of pollutants into the atmosphere surrounding the mining machine.

* * * * *